US008923540B2

(12) United States Patent
Boldt et al.

(10) Patent No.: US 8,923,540 B2
(45) **Date of Patent: *Dec. 30, 2014**

(54) ONLINE ANTI-FEEDBACK SYSTEM FOR A HEARING AID

(71) Applicant: Oticon A/S, Smorum (DK)

(72) Inventors: Jesper Bünsow Boldt, Smorum (DK); Thomas Bo Elmedyb, Smorum (DK)

(73) Assignee: Oticon A/S, Smorum (DK)

( * ) Notice: Subject to any disclaimer, the term of this patent is extended or adjusted under 35 U.S.C. 154(b) by 0 days.

This patent is subject to a terminal disclaimer.

(21) Appl. No.: 13/924,341

(22) Filed: Jun. 21, 2013

(65) Prior Publication Data

US 2014/0010395 A1 Jan. 9, 2014

Related U.S. Application Data

(63) Continuation of application No. 12/664,355, filed as application No. PCT/EP2008/056898 on Jun. 4, 2008, now Pat. No. 8,503,705.

(30) Foreign Application Priority Data

Jun. 12, 2007 (EP) ..... 07110079

(51) Int. Cl.
*H04R 25/00* (2006.01)

(52) U.S. Cl.
CPC ..... *H04R 25/453* (2013.01); *H04R 25/505* (2013.01); *H04R 25/552* (2013.01); *H04R 25/554* (2013.01); *H04R 2430/03* (2013.01)
USPC ..... 381/318; 381/312; 381/321

(58) Field of Classification Search
CPC ..... H04R 2430/03; H04R 25/453; H04R 25/505; H04R 25/45; H04R 25/70; H04R 225/41; H04R 3/02; H04R 25/552; H04R 25/554; H04R 25/658
USPC ..... 381/312, 317, 318, 320, 321, 71.1, 381/71.11, 71.12, 71.14, 83, 93, 94.1, 94.2, 381/94.3
See application file for complete search history.

(56) References Cited

U.S. PATENT DOCUMENTS 5,091,952 A * 2/1992 Williamson et al. ..... 381/318
5,619,580 A 4/1997 Hansen (Continued)

FOREIGN PATENT DOCUMENTS

EP 1 191 814 A1 3/2002
EP 1471765 A2 10/2004

(Continued)

*Primary Examiner* — Huyen D Le
(74) *Attorney, Agent, or Firm* — Birch, Stewart, Kolasch & Birch, LLP

(57) ABSTRACT

A hearing aid system may include an ear-mould for a child, an output transducer, and an electrical feedback path. A forward path includes a signal processor that modifies an electrical input signal to a specific hearing profile over a predefined frequency range which includes a number of frequency bands. Maximum forward gain values $IG_{max}$ for each band are stored in a memory, restricting loop gain to a predetermined value in each band. The hearing aid system further includes a relatively slow online feedback manager unit configured to, with a predefined update frequency, identify current feedback gain in each frequency band, and to subsequently adapt the maximum forward gain values $IG_{max}$ in each of the frequency bands in accordance with a predefined scheme. The feedback manager unit is thus reduces the risk of howling by decreasing the maximum forward gain values $IG_{max}$ in said ear-mould for a child.

20 Claims, 8 Drawing Sheets

(56) References Cited

U.S. PATENT DOCUMENTS

| | | | | |
|---|---|---|---|---|
| 6,219,427 | B1 | 4/2001 | Kates et al. | |
| 7,801,318 | B2 | 9/2010 | Barthel | |
| 8,503,705 | B2 * | 8/2013 | Boldt et al. | 381/318 |
| 2004/0125973 | A1 | 7/2004 | Fang et al. | |
| 2004/0136557 | A1 | 7/2004 | Kaulberg | |
| 2005/0226427 | A1 | 10/2005 | Hersbach et al. | |
| 2006/0245610 | A1 | 11/2006 | Chalupper | |
| 2010/0296680 | A1 * | 11/2010 | Korl et al. | 381/318 |
| 2011/0249847 | A1 * | 10/2011 | Salvetti et al. | 381/318 |

FOREIGN PATENT DOCUMENTS

| | | | |
|---|---|---|---|
| WO | WO 2006/063624 | A1 | 6/2006 |
| WO | WO 2007/113282 | A1 | 10/2007 |

* cited by examiner

ONLINE ANTI-FEEDBACK SYSTEM FOR A HEARING AID

This application is a Continuation of co-pending application Ser. No. 12/664,355, filed on Jan. 8, 2010, and for which priority is claimed under 35 U.S.C. §120. application Ser. No. 12/664,355 is the national phase of PCT International Application No. PCT/EP2008/056898 filed on Jun. 4, 2008 under 35 U.S.C. §371. This application claims priority of Application No. EP 07110079.6 filed on Jun. 12, 2007, under 35 U.S.C. §119; the entire contents of all are hereby incorporated by reference.

TECHNICAL FIELD

The invention relates to feedback compensation in a hearing aid system comprising a feedback path with an adaptive filter for estimating acoustical feedback from an output transducer to an input transducer of the hearing aid system. The invention furthermore relates to a method of adapting a hearing aid system to varying acoustical input signals, and to a method of manufacturing a hearing aid system.

The invention may e.g. be useful in digital hearing aids for use in a variety of acoustical environments.

BACKGROUND ART

It is a well known problem that a hearing aid can become unstable and howl when loop gain exceeds 1. The (open) loop gain is a product of the gain in the hearing aid and the coupling between the receiver (speaker) and microphone, primarily, but not exclusively, through a vent in the earpiece. The vent is generally inserted in the earpiece of hearing aids so as to avoid occlusion. The coupling between the receiver and microphone is called the external or physical or acoustical feedback path and may have other origins than a deliberately arranged vent, e.g. mechanical coupling between various parts of the earpiece, etc.

Two methods can be used to help in situations where loop gain gets too high: Either by subtracting an estimate of the external feedback from the input signal (the microphone signal) or by reducing the gain in the hearing aid. The first method is used in so-called Dynamic Feedback Cancellation (DFC) or Anti-Feedback (AFB) systems, these terms are used interchangeably in the present application. This method has the advantage that the loop gain can exceed 1 without howls, meaning that the hearing impaired can get more gain or a larger vent compared to a situation without a DFC/AFB-system. A schematic illustration of a hearing aid system comprising a forward path, an acoustic feedback path and an electric feedback cancellation path is shown in FIG. 1*b*. The second method is sometimes used in the fitting situation, where the external feedback is measured and the maximum allowable gain is adjusted ('the feedback manager', FBM). But this is typically a one-time (offline) measurement, possibly performed by a technician, such as an audiologist, typically using specially adapted equipment.

U.S. Pat. No. 5,619,580 describes a hearing aid with digital, electronic compensation for acoustic feedback comprising a digital compensation circuit, including an adjustable digital filter and a first part, which monitors the loop gain and regulates the hearing aid amplification, so that the loop gain is less than a constant K, and a second part, which carries out a statistical evaluation of the filter coefficients, and changes the feedback function in accordance with this evaluation.

U.S. Pat. No. 6,219,427 deals with a digital hearing aid comprising a feedback cancellation system in the form of a cascade of two adaptive filters, a first filter for modelling near constant factors in the physical feedback path, and a second, quickly varying, filter for modelling variable factors in the feedback path, the first filter varying substantially slower than the second filter.

Published PCT-application WO 2006/063624 describes a hearing aid comprising a processor for amplifying an electrical input signal, an adaptive feedback suppression filter and a feedback model gain estimator that determines an upper processor gain limit based on inputs from the microphone, the adaptive filter, and the output form the processor.

EP 1 191 814 A1 deals with a hearing aid with an adaptive filter for suppression of acoustic feedback and a controller that is adapted to compensate for acoustic feedback by determination of a first parameter of an acoustic feedback loop of the hearing aid and adjustment of a second parameter of the hearing aid in response to the first parameter whereby generation of undesired sounds is substantially avoided.

DISCLOSURE OF INVENTION

An object of the present invention is to provide an alternative acoustic feedback compensation scheme. In particular, it is an object of the present invention to provide a system and a method for adapting the feedback compensation scheme of a hearing aid to changing conditions of a wearer of the hearing aid and/or the acoustical environment over time (typically over time scales of the order of seconds, minutes, days or months).

The general idea disclosed herewith relates to an online anti-feedback system, which continuously avoids or suppresses howls, by estimating the feedback path and adjusting the maximum allowable gain in the hearing aid. The online anti-feedback system of the present invention uses the feedback path estimate to adjust maximum gain in the forward path (termed 'insertion gain' in the following). Thereby the resulting loop gain can be controlled. In an embodiment, the adjustment of the maximum allowable gain in the forward path is based solely on the feedback estimate (and predefined maximum loop gain values, without considering current loop gain). In a particular embodiment, the system is adapted to perform the adjustment of the maximum allowable gain in the forward path slowly compared to a normal, instantaneous feedback compensation system, e.g. with an update frequency smaller than 0.5 Hz or smaller than 0.1 Hz or smaller than 0.05 Hz or smaller than 0.01 Hz or smaller than 0.001 Hz.

Definition of Terms:

The frequency dependent loop gain LG in the loop comprising the forward path and the electrical feedback path is the sum of the (insertion) gain IG in the forward path, also termed 'forward gain' (e.g. fully or partially implemented by a signal processor (SP)) and the gain FBG in the electrical feedback path aimed at minimizing, preferably cancelling, the acoustical feedback between the receiver and the microphone of the hearing aid system (i.e. in a logarithmic representation, $LG(f)=IG(f)+FBG(f)$, where f is the frequency). In practice, the frequency range $\Delta f=[f_{min}; f_{max}]$ considered by the hearing aid system, e.g. limited to a part of the typical human audible frequency range, e.g. 20 Hz≤f≤20 kHz, is divided into a number N of frequency bands (FB), e.g. N=16, ($FB_1$, $FB_2$, . . . , $FB_N$) and the expression for the loop gain can be expressed in dependence of the frequency bands, i.e. $LG(FB_i)=IG(FB_i)+FBG(FB_i)$, i=1, 2, . . . , N, or simply $LG_i=IG_i+FBG_i$. In a given frequency band k, values of current loop gain, $LG(t_n)$, and current feedback gain, $FBG(t_n)$, used are typically maximum values of the parameter in question at the given time frame $t_n$ and frequency band i (termed $LG_{max,i}(t_n)$ and $FBG_{max,i}(t_n)$, respectively).

In a typical fitting process, predefined (pd) maximum acceptable values for a given frequency band i of loop gain, $LG_{max,i}(pd)$, to avoid feedback oscillation are determined and stored in the hearing aid (e.g. set to different values from frequency band to frequency band or set to a constant value, e.g. −2 dB, in all frequency bands). Additionally or alternatively, predefined maximum acceptable values for a given frequency band i of insertion gain $IG_{max,i}(pd)$ can be determined and stored in the hearing aid. The $IG_{max,i}(pd)$-values are e.g. based on the predefined maximum acceptable values of loop gain and on assumptions of maximum predictable feedback gain values, $FBG_i(pd)$, (such values being dependent on the type of hearing aid, the size of a possible vent, etc.). The latter is illustrated by FIG. 7, where different settings of the predefined maximum acceptable (forward) insertion gain $IG_{max}$ vs. frequency f (or frequency band $FB_i$, i=1, 2, . . . , 8) of the processor of a hearing aid system for the frequency range $[f_{min}; f_{max}]$ between a minimum frequency $f_{min}$ and a maximum frequency $f_{max}$ are schematically shown. The graph $IG_{max\text{-}std}$ indicates a standard setting of the predefined maximum acceptable forward gain for the different frequency bands, such as e.g. the (relatively conservative) setting of a hearing aid system directly from the manufacturer. $IG_{max\text{-}FBM}$ indicates a setting of predefined values (pd) of maximum acceptable forward gain, such as e.g. adapted by a hearing aid specialist, e.g. an audiologist, e.g. manually or using an offline 'feedback manager' (or using an automated procedure, e.g. a software tool running on a PC) to adjust the settings to a hearing profile of a given user (typically overriding the standard values $IG_{max\text{-}std}$ from the manufacturer). The graphs $IG_{max\text{-}OFBM}(t_n)$ schematically indicate values of the maximum acceptable forward gain for each frequency band at time $t_n$ as suggested by the present invention, here indicated by times $t_1$, $t_2$, $t_3$ and which may successively substitute the predefined maximum acceptable forward gain values $IG_{max\text{-}FBM}$ set by a hearing aid specialist (see later) or $IG_{max\text{-}std}$ as set by a manufacturer.

Current insertion gain, $IG(t_n)$, for a given frequency band k and point in time $t_n$, termed $IG_k(t_n)$, is typically equal to the value of insertion gain for frequency band k as determined in the signal processor (here termed the 'requested insertion gain' $IG_{req,k}(t_n)$) based on the current input signal (including its level), the predefined compression scheme, the users audiogram, etc. However, in the context of the present invention, the current insertion gain for the band in question, $IG_k(t_n)$, can be modified subject to limitations based on the predefined maximum acceptable insertion gain $IG_{max}(pd)$ (or loop gain $LG_{max}(pd)$) as defined above OR according to later determined (and stored) values of maximum acceptable insertion gain, $IG_{max,i}(t_n)$, as described later.

Objects of the invention are achieved by the invention described in the accompanying claims and as described in the following.

A Hearing Aid System:

An object of the invention is achieved by a hearing aid system comprising an input transducer, a forward path, an output transducer and an electrical feedback path, the forward path comprising a signal processing unit for modifying an electrical input signal to a specific hearing profile over a predefined frequency range, wherein the predefined frequency range comprises a number of frequency bands, for which at least maximum (allowable) forward gain values $IG_{max}$ for each band are or can be stored in a memory, the electrical feedback path comprising an adaptive filter for estimating acoustical feedback from the output to the input transducer. Advantageously, the hearing aid system further comprises an online feedback manager unit (OFBM) for—with a predefined update frequency—identifying current feedback gain in each frequency band of the feedback path, and for subsequently adapting the maximum (allowable) forward gain values in each of the frequency bands in dependence thereof in accordance with a predefined scheme. Preferably, the update frequency is smaller than 0.5 Hz or smaller than 0.1 Hz or smaller than 0.05 Hz or smaller than 0.01 Hz or smaller than 0.001 Hz corresponding to a relatively slow online feedback manager as described in more detail later.

This has the advantage of providing a diminished probability for disturbing feedback improved feedback cancellation.

The value of current feedback gain determined by the adaptive filter or the online feedback manager for a particular frequency band may vary across the frequency band. In principle any of the values for a given frequency band determined at a given point in time may be used (e.g. the value corresponding to the middle frequency of the band, or to the minimum or maximum frequency of the band or e.g. the minimum value of the band). Preferably, however, the 'current feedback gain' value used for a particular frequency band i is the maximum value of current feedback gain in the band at the actual point in time ($t_n$), $FBG_{max,i}(t_n)$. The maximum value FBG in a set of feedback gain values $FBG_i(t_n)$ for a particular frequency band i may be determined e.g. by a standard software routine.

In the present application, a differentiation between 'online' and 'offline' adjustment of a hearing aid is made. 'Offline' adjustment is taken to refer to adjustments made (infrequently, e.g. less than once a week or month) using external or additional instruments, e.g. at special occasions such as an initial or later fitting of the hearing aid, e.g. performed by another person (e.g. an audiologist) than the wearer of the hearing aid. 'Online' adjustment is taken to refer to adjustments that can be made by the hearing aid itself, e.g. automatically or initiated by a wearer, e.g. in-situ, without any external instruments.

The term 'update frequency' in relation to the online feedback manager is taken to mean the frequency of checking the above criterion of 'identifying current feedback gain in each frequency band of the feedback path, and for subsequently adapting the maximum forward gain values in each of the frequency bands in dependence thereof in accordance with a predefined scheme'. The storage of possible maximum forward gain values may be performed at the same or at a lower frequency than the update frequency, possibly depending on whether or not a change to a value of one or more of the frequency bands has occurred since the last check. In an embodiment, storage is performed every time at least one maximum forward gain value of a frequency band has been changed.

The parts of a hearing aid system according to the present invention are body worn and can be located in a common housing and e.g. worn behind the ear (BTE) or in the ear canal, or alternatively be located in different housings, one e.g. located in the ear canal another behind the ear or worn elsewhere on the body of the wearer. The communication between the two or more housings can be acoustical and or electrical and/or optical. The electrical and optical communication can be wired or wireless. In an embodiment, the input transducer and the processing unit (including the OFBM) are enclosed in the same physical unit and located e.g. behind an ear or in an ear canal.

Embodiments of an online feedback manager according to the invention can work in at least three different configurations. With or without an AFB system, and in a relatively fast or slow mode:

1. Without AFB System—Relatively Fast Online Feedback Manager.

The online feedback manager (OFBM) continuously (i.e. with a certain update frequency) calculates the loop gain (e.g. based on an estimate of the current feedback gain from an adaptive filter and a requested current insertion gain from a signal processor) and adjusts the forward gain in the hearing aid so as to prevent the loop gain to exceed a certain (predefined) loop gain limit. In this configuration the loop gain limit must be below zero (e.g. $LG_{max}$=−5 dB). The OFBM must be fast enough to react to quickly changing feedback paths e.g. caused by using a headset, putting on a hat, or passing a wall. In an embodiment, the update frequency of the OFBM is larger than or equal to once every second (1 Hz), such as larger than or equal to 5 Hz, such as larger than or equal to 10 Hz.

2. With AFB System—Relatively Fast Online Feedback Manager.

In this configuration the OFBM is working as a safety measure in cooperation with an AFB system. Present day AFB systems make it possible to increase the loop gain without introducing howls and artefacts, and it is possible to increase the loop gain above 0 dB. However, the AFB will always be restricted, which means that the loop gain can not increase infinitely—the AFB system has a maximum loop gain under which it can operate (e.g. <+5 dB loop gain, i.e. $LG_{max}$=+5 dB). If the loop gain exceeds this maximum, the OFBM will decrease the gain in the hearing aid so as to prevent conditions where the AFB system can not work acceptable. The OFBM must be fast enough to react to quickly changing feedback paths e.g. caused by using a headset, putting on a hat, giving a hug, or passing a wall. In an embodiment, the update frequency of the OFBM is larger than or equal to once every hour, such as once every second (1 Hz), such as larger than or equal to 5 Hz, such as larger than or equal to 10 Hz.

3. With AFB System—Relatively Slow Online Feedback Manager.

This embodiment of the system can best be compared to an off-line feedback manager used in the fitting situation (i.e. occasionally). The slow OFBM will slowly update the estimate made with the off-line feedback manager (of predetermined values of $IG_{max,i}$ and/or $LG_{max,i}$). Compared to previous systems (1 and 2) which are "reactive", this system (3) is "preventive": Reactive in the sense that the fast OFBM is active, when the loop gain gets too high. Preventive in the sense that the slow OFBM tries to avoid that the loop gain gets too high. Target situations for this mode of operation are to deal with a) broken or badly fitted ear-moulds, b) wrong settings of the hearing aid (e.g. too much gain or too little gain), c) ear-moulds for children (which typically become too small during child growth) d) or other slow changes in the feedback. In an embodiment, the update frequency of the OFBM is larger than or equal to once every 100 hours, such as larger than or equal to once every 10 hours, such as larger than or equal to once every 2 hours, such as larger than or equal to once every hour. In an embodiment, the slow OFBM is adapted to accommodate changes in feedback that may occur during the day, e.g. due to minor changes in the 'local environment' of an earpiece due to a wearer's physical activity (e.g. resulting in sweat being produced in the ear canal), the ear canal exhibiting slight changes in dimensions, etc. Such variations may be taken account for by OFBM updates being performed in the range every 5-60 minute, e.g. every $20^{th}$ or every $30^{th}$ minute. In a particular embodiment, the predefined update frequency $f_{upd}$ is smaller than or equal to 0.01 Hz, such as smaller than or equal to 0.003 Hz. In an embodiment, the predefined update frequency of the OFBM is larger than or equal to once every 100 hours, while smaller than or equal to once every 5 minutes, i.e. $1/(100*60*60\ s) \leq f_{upd} \leq 1/(5*60\ s)$, i.e. $f_{upd}$ is in the range from $2.78\cdot10^{-6}$ Hz to $3.33\cdot10^{-3}$ Hz.

In an embodiment (e.g. of a slow OFBM), the maximum gain values of the forward path $IG_{max,i}$ for a particular frequency band i are continuously updated (with the predefined update frequency) independently of current loop gain $LG_i$ in the band. Thereby new values of the maximum acceptable insertion gain values, $IG_{max,i}(t_n)$, are created (and stored instead of the previous values, which e.g. are predetermined values from an off-line fitting or corresponding values determined in a previous point in time, $t<t_n$ by the OFBM), at every increment $(t_n-t_{n-1})$ of the time between updates (assuming that $f_{upd}=1/(t_n-t_{n-1})$).

In an embodiment, a relatively fast as well as a relatively slow OFBM is implemented in the same hearing aid system.

In an embodiment, each of the relatively fast and relatively slow OFBM may be activated or deactivated by a software setting. In an embodiment, each may be activated or deactivated individually on a per frequency band level. In an embodiment, the relatively slow OFBM is dependent on the relatively fast OFBM. In an embodiment, the relatively slow OFBM uses inputs from the relatively fast OFBM.

The target for the OFBM is either to reduce the risk of howling by decreasing the max insertion gain, or to increase the max insertion gain in situations where the risk of howling is reduced.

In an embodiment, the system builds on an existing anti-feedback mechanism (max gain in forward path) but will make it adaptive/variable.

In an embodiment, the OFBM makes it possible to increase or decrease the forward gain depending on the current situation.

In an embodiment, the OFBM has only a direct effect on the current gain ($IG_i(t_n)$), when the requested gain ($IG_{req,i}(t_n)$) is above the maximum gain.

The OFBM system can either be preventive or reactive. A preventive OFBM will continuously try to optimize the performance and reduce the risk of the DFC system being pushed too hard. A reactive OFBM will try to help in situations where the DFC system has been pushed too hard and artefacts and bad sound quality are present.

In a particular embodiment, the predefined scheme comprises that the maximum forward gain value for a frequency band is adapted so that the sum of the current feedback gain and the maximum forward gain values in that particular frequency band is smaller than a predefined maximum loop gain value for that band.

In a particular embodiment, the maximum forward gain value is adapted so that the sum of the current feedback gain and the maximum forward gain values is equal to a predefined maximum loop gain value for that band. Thereby the maximum forward gain value for a particular frequency band can be increased or decreased depending on the actual values of current feedback gain and the maximum loop gain values currently stored for that band.

In a particular embodiment, the predefined maximum loop gain value is substantially identical for all frequency bands. Alternatively, the predefined maximum loop gain value can be different from band to band or from a range of bands to another range of bands (e.g. from relatively low frequency bands to relatively high frequency bands).

In a particular embodiment, different sets of predefined maximum loop gain values and/or predefined maximum allowable insertion gain values are stored corresponding to different modes of the OFBM, e.g. to a mode where the OFBM operates without an AFB-system in a relatively fast mode, to a mode where the OFBM cooperates with an AFB system in a relatively fast mode, and to a mode where the OFBM cooperates with an AFB system in a relatively slow mode.

In a particular embodiment, the predefined scheme comprises that the maximum forward gain values for all frequency bands are adapted every time the OFBM is updated. Alternatively, the update frequency can be different for different frequency bands, e.g. relatively higher at frequency bands comprising relatively higher frequencies and relatively lower at frequency bands comprising relatively lower frequencies. Further, in an embodiment, the OFBM can be selectably switched on or off for a particular frequency band.

In a particular embodiment, a predefined maximum loop gain value $LG_{max,i}$(pd) (which may be different from frequency band to frequency band) is +12 db, such as +10 dB, such as +5 dB, such as +2 dB, such as 0 dB, or such as −2 dB. The (predefined) maximum loop gain $LG_{max,i}$(pd) in a particular frequency band i is e.g. determined from an estimate of the maximum allowable loop gain before howling occurs ($LG_{howl,i}$) diminished by a predefined safety margin ($LG_{margin,i}$). In an embodiment, the predefined maximum loop gain values $LG_{max,i}$(pd) are determined on an empirical basis, e.g. from a trial and error procedure, e.g. based on a users typical behaviour (actions, environments, etc.).

In a particular embodiment, the predefined frequency range is from 20 Hz to 20 kHz, such as from 20 Hz to 12 kHz, such as from 20 Hz to 8 kHz.

In a particular embodiment, the predefined frequency range comprises at least 2 frequency bands, such as at least 4, such as at least 8, such as at least 12, such as at least 16, such as at least 32 bands. The more frequency bands, the more detailed an adaptation to a user's hearing profile can be made. In an embodiment, the frequency bands form sequentially neighbouring ranges, together constitute the predefined frequency range considered by the signal processing unit (such as e.g. indicated by $FB_1$-$FB_8$ of FIG. 7 together constituting the full frequency range [$f_{min}$; $f_{max}$] considered by the signal processor).

In an embodiment, the compression is the same in all frequency bands. The term compression is in the present context taken to refer to the phenomenon that the processing of an input signal is performed in such a way that a certain input level range is mapped to a smaller output level range than would otherwise have been set to compensate for the hearing loss of the user (i.e. the input signal is attenuated (compared to the, e.g. linear, mapping at relatively lower input levels) at a particular frequency, if the input level at that frequency is above a predefined level). However, alternatively, the compression can be different in different frequency bands. This has the advantage that a more flexible adaptation to the frequency dependent hearing profile and level sensitivity of a particular user can be provided.

In a particular embodiment, the update frequency is adapted to the relevant hearing situation, e.g. based on one or more particular sensors for classifying the present environment (e.g. directional microphones or external signals forwarding such information to the hearing aid) and/or based on recorded data of the frequency of howl appearing in a predefined time period, e.g. the last minute or the last 10 minutes or the last hour.

In a particular embodiment, the order of the update frequency is in the once a second range, or in the once a minute range, or in the once an hour range or in the once every 10 hours range or in the once every 100 hours range.

In a particular embodiment, the hearing aid system is adapted to provide an update frequency larger than or equal to 0.001 Hz, such as larger than or equal to 0.01 Hz, such as larger than or equal to 0.1 Hz, such as larger than or equal to 1 Hz, such as larger than or equal to 10 Hz, such as larger than or equal to 100 Hz, such as larger than or equal to 1 kHz. In a particular embodiment, the update frequency is in the range between 0.001 Hz and 1 kHz, such as in the range between 0.005 Hz and 0.05 Hz or between 0.5 Hz and 5 Hz or between 50 Hz and 500 Hz.

An OFBM according to the invention can be fully or partially implemented in a digital signal processor of the hearing aid system and can be fully or partially implemented in software.

An algorithm for an embodiment of an OFBM can be described as follows (it is anticipated that predefined values of loop gain $LG_{max,i}$(pd) and/or insertion gain $IG_{max,i}$(pd) for the different frequency bands i=1, 2, . . . , N are stored in a memory of the hearing aid system):

1. Estimate feedback path H' (to provide $FBG_i(t_n)$).
2. Find maximum feedback gain $FBG_{max,i}(t_n)$ in each frequency band.
3. Adapt the current maximum forward gain $IG_{max,i}(t_n)$ in dependence of the current maximum feedback gain $FBG_{max,i}(t_n)$ in that frequency band.

In this algorithm, the current maximum forward gain $IG_{max,i}(t_n)$ is modified without calculating current loop gain $LG_{max,i}(t_n)$. $IG_{max,i}(t_n)$ is calculated as $LG_{max,i}$(predefined)−$FBG_{max,i}(t_n)$ and used to possibly limit the current forward (insertion) gain $IG_{req,i}(t_n)$ requested by the signal processor. $IG_{max,i}(t_n)$ is e.g. stored in a memory of the hearing aid system instead of a previous value of $IG_{max,i}$, e.g. $IG_{max,i}(t_{n-1}$, or $IG_{max,i}$(pd), thereby implementing a relatively slow online feedback manager (if a correspondingly low update frequency is chosen, e.g. fupd<0.5 Hz). If the $IG_{max,i}(t_n)$ values are not stored and a relatively large update frequency (e.g. $f_{upd}$>1 Hz) is chosen, a relatively fast online feedback manager is implemented. The hearing aid system is adapted to run the algorithm at different points in time $t_1, t_2, \ldots, t_n, \ldots$.

Another algorithm for an embodiment of an (relatively fast) OFBM can be described as follows (again, it is anticipated that predefined (pd) values of $LG_{max,i}$ and/or $IG_{max,i}$ for the different frequency bands i=1, 2, . . . , N are stored in a memory of the hearing aid system):

1. Estimate feedback path H' (to provide $FBG_i(t_n)$).
2. Find maximum feedback gain $FBG_{max,i}(t_n)$ in each frequency band (also termed compression channels).
3. Calculate the current maximum loop gain $LG_{max,i}(t_n)$ in each of the frequency bands.
4. If the loop gain $LG_{max,i}(t_n)$ is above a certain limit ($LG_{max,i}$(pd)), decrease the current insertion gain $IG_i(t_n)$ in that frequency band (compared to the requested insertion gain value $IG_{req,i}(t_n)$).

The hearing aid system is adapted to run the algorithm at different points in time $t_1, t_2, \ldots, t_n, \ldots$.

A more detailed algorithm for an embodiment of an (relatively slow) OFBM for a time increment between $t_{n-1}$ and $t_n$ can be described as follows (again, it is anticipated that predefined (pd) values of $LG_{max,i}$, $LG_{max,i}$(pd), and/or $IG_{max,i}$, $IG_{max,i}$(pd), for the different frequency bands i=1, 2, . . . , N are stored in a memory of the hearing aid system):

1. Estimate the gain versus frequency FBG(f) of the feedback path H' at a given time $t_n$. This can e.g. be done using an adaptive filter, such as an LMS filter, providing $FBG_i(t_n)$.
2. Find the estimated maximum feedback gain $FBG_{max,i}$ in each frequency band $FB_i$ (compression channels) at $t_n$. This can e.g. be done by computing the frequency response of the estimated feedback path and finding the maximum feedback gain in each frequency band.
3. Calculate the maximum loop gain $LG_{max,i}$ at $t_n$ in each of the frequency bands $FB_i$ based on the estimated maximum feedback gain values $FBG_{max,i}$ at $t_n$ and the stored maximum forward gain values $IG_{max,i}$ for each frequency band. The stored $IG_{max,i}$ values are typically those stored in a previous cycle, e.g. at $t=t_{n-1}$ (or earlier or such values stored from the manufacturer or in a fitting situation, i.e. predefined values (pd)).
4. For each frequency band: If the current maximum loop gain LG is larger than or equal to a predefined maximum loop gain value $LG_{max,i}(t_n)(pd)$, adapt the current maximum forward gain $IG_{max,i}(t_n)$ in that frequency band (i) according to a predefined scheme.
5. In case $IG_{max,i}(t_n)$ is different from $IG_{max,i}(t_{n-1})$, store the new maximum forward gain values $IG_{max,i}(t_n)$ for each frequency band. These are valid at least until the next estimate of the feedback path is performed at time $t_{n+1}>t_n$.

$t_n-t_{n-1}$ (and $t_{n+1}-t_n$) represents a time interval between two updates of the OFBM.

In case the system is automatically updated at regular intervals, $1/(t_{n+1}-t_n)$ $(=1/(t_n-t_{n-1}))$ represents an update frequency $f_{upd}$ of the OFBM.

In an embodiment (e.g. alternatively to step 5 above), a just determined value of a parameter, here $IG_{max,i}$, at $t=t_n$ is not immediately used, but termed the 'target value'. Predefined fade-rates $FR_i$ [db/time step] for each frequency band are used. In an embodiment, the present value of $IG_{max,i}$, $IG_{max,i}(t_{n-1})+SUM[FR_i(t_n-t_{n-1})]$, is adapted to 'fade' (converge) towards the just determined value $IG_{max,i}(t_n)$ at a (fade) rate of $FR_i$, where the summation, SUM, is over time steps from $t=t_{n-1}$ to the present time up to $t=t_n$. In an embodiment, $FR_i$ is different for positive and negative changes to $IG_{max,i}$. In an embodiment, the fade rate $FR_{i-}$ is larger for a negative change $(IG_{max,i}(t_n)<IG_{max,i}(t_{n-1}))$ than the fade rate $FR_{i+}$ for a positive change in $IG_{max,i}$ to provide a relatively fast adjustment in case of a too high gain is detected.

In an embodiment, in step 4 the current maximum forward gain $IG_{max,i}(t_n)$ is adapted to provide that the current maximum loop gain $LG_{max,i}(t_n)$ is smaller than the predefined maximum loop gain value $LG_{max,i}(pd)$ for frequency band i.

In an embodiment, in step 4 the current maximum forward gain $IG_{max,i}(t_n)$ is adapted to provide that the current maximum loop gain $LG_{max,i}(t_n)$ is substantially equal to the predefined maximum loop gain value $LG_{max,i}(pd)$ for frequency band i.

In an embodiment, $LG_{max,i}(pd)\leq 12$ dB, such as $LG_{max,i}(pd)\leq 10$ dB, such as $LG_{max,i}(pd)\leq 5$ dB, such as $\leq 4$ dB, such as $\leq 3$ dB, such as $\leq 2$ dB, such as $\leq 1$ dB, such as $\leq 0$ dB, such as $\leq -1$ dB.

In an embodiment, the algorithm is run at regular intervals in time, with a predefined update frequency $f_{upd}$. In an embodiment, $f_{upd}=1/(t_{n+1}-t_n)$.

In an embodiment, a set of update values (of current feedback gain and/or maximum forward gain) from a number of update times $t_1, t_2, \ldots, t_q$ (possibly corresponding to a certain update frequency or to a number of non-periodic, e.g. user initiated, update times) are stored in a memory and an average value is calculated for the time period $t_1$-$t_q$ and this value is used for the next period of time (e.g. of length $t_q$-$t_1$), after which the values stored in the next period are averaged and so on.

In particular embodiments, the update frequency of the OFBM is adapted to the relevant situations where it can improve the performance, for example hug (~1 s.), chewing/yawning (~1 s.), telephone (~1-10 min.), putting on a hat (~1 hour), change of the mould/ear channel through the day (~10 hours), change of the mould/ear channel through days (~100 hours), where the times in parentheses represent typical times between updates for the situation in question (i.e. ~$1/f_{upd}$). In a particular embodiment, the update or update frequency of the OFBM can be activated or influenced by a user. In a particular embodiment, the update or update frequency of the OFBM is only activated or determined by a user. In a particular embodiment, the update or update frequency of the OFBM is activated or influenced by events in the acoustical environment of the hearing aid system, e.g. changing background noise or a change from sound without voice signals to sound including voice-signals (or vice versa). I an embodiment, the update or update frequency of the OFBM is activated or influenced by an external signal. In an embodiment, the external signal is forwarded to the hearing aid by a transmitter located in a particular acoustical environment, e.g. in a particular room of a building, in a transport facility, etc.

In a particular embodiment, the effect of the OFBM is limited, e.g. to +/−5 dB of the initial max gain. In a particular embodiment, the OFBM is constrained to a predefined maximum change, e.g. only to be allowed to make maximum of +/−2 dBs of change. This has the advantage of reducing the risk of making too large and sudden changes (e.g. increases in gain). In a particular embodiment, the OFBM is constrained to only be able to decrease the max gain.

In a particular embodiment, the effect of the OFBM is adapted to be frequency dependent in that the adjustment of maximum (and/or minimum) gain in at least one frequency band is different from other frequency bands.

In a particular embodiment, the OFBM is adjustable in the fitting situations in that e.g. a choice between higher gain/higher risk of howls or lower gain/lower risk of howls can be made. By increasing the ('predefined') maximum allowable loop gain $(LG_{max,i}(pd))$, the signal is better in certain situations, but the risk of experiencing howl in certain situations is increased, and vice versa.

In a particular embodiment, the OFBM is adapted to use information from other sub systems (e.g. environmental detectors or external signals indicating the kind or acoustical environment currently present) in the HA to increase the performance by making the decisions more confident (e.g. by influencing the update frequency).

A Method of Adapting a Hearing Aid System:

In a further aspect, there is provided a method of adapting a hearing aid system to varying acoustical input signals, the hearing aid system comprising an input transducer transforming an acoustical input signal to an electrical input signal, a forward path, an output transducer for transforming an electrical output signal to an acoustical output signal and a feedback path, the forward path comprising a signal processing unit for modifying an electrical input signal to a specific hearing profile over a predefined frequency range, wherein the predefined frequency range comprises a number of frequency bands that can be individually adapted, the feedback path comprising an adaptive filter for estimating acoustical feedback from the output to the input transducer. Advantageously, the method comprising a) identifying maximum feedback gain in each frequency band, b) calculating the (current maximum) loop gain in each of the frequency bands based on previously stored values of maximum forward gain and said maximum feedback gain, c) checking whether the (current maximum) loop gain is above a certain (predefined) maximum loop gain value in each frequency band, d1) if yes, decreasing the maximum forward gain in that frequency band, d2) if no, depending on a predefined first OFBM-parameter, increasing the maximum forward gain OR continue without changing the maximum forward gain in that frequency band, e) storing in a memory the new values of the maximum forward gain in each frequency band, f) repeating the algorithm a)-e) with a predefined update frequency. Preferably, the update frequency is smaller than 0.5 Hz or smaller than 0.1 Hz or smaller than 0.05 Hz or smaller than 0.01 Hz or smaller than 0.001 Hz corresponding to a relatively slow online feedback manager.

In a particular embodiment, in step d) the maximum forward gain is decreased or increased with a predefined amount, e.g. 0.5 dB, 1 dB or 2 dB.

In a particular embodiment, in step d) the maximum forward gain is decreased or increased at most to a predetermined fraction of (such as down or up to) said predetermined maximum loop gain value in each frequency band.

In a particular embodiment, the predetermined maximum loop gain values are identical in all frequency bands. They might alternatively be different for some or all bands.

The features of the hearing aid system described above, in the detailed description and in the claims are—where appropriate—intended for being combined with the present method of adapting a hearing aid system.

A Method of Manufacturing a Hearing Aid System:

A method of manufacturing a hearing aid system is moreover provided by the present invention, the method comprising a) providing an input transducer for transforming an acoustical input signal to an electrical input signal, b) providing an output transducer for transforming an electrical output signal to an acoustical output signal, c) providing an electrical forward path between the input and output transducers, the forward path comprising a signal processing unit for modifying an electrical input signal to a specific hearing profile over a predefined frequency range, and providing that the input signal can be individually adapted in a number of frequency bands included in the predefined frequency range, d) providing an electrical feedback path comprising an adaptive filter for estimating acoustical feedback from the output to the input transducer, e) providing an algorithm for adjusting the gain in the forward path, the algorithm comprising e1) identifying the maximum feedback gain in each frequency band, e2) calculating the (current maximum) loop gain in each of the frequency bands based on previously stored values of maximum forward gain and said maximum feedback gain, e3) checking whether the (current maximum) loop gain is above a certain (predefined) maximum loop gain value in each frequency band, e4) if yes, decreasing the maximum forward gain in that frequency band, e5) if no, depending on a predefined first OFBM-parameter, increasing the maximum forward gain OR continue without changing the maximum forward gain in that frequency band, g) storing in a memory the new values of the maximum forward gain in each frequency band, h) repeating the algorithm e)-g) with a predefined update frequency. Preferably, the update frequency is smaller than 0.5 Hz or smaller than 0.1 Hz or smaller than 0.05 Hz or smaller than 0.01 Hz or smaller than 0.001 Hz corresponding to a relatively slow online feedback manager.

The features of the hearing aid system and of the method of adapting a hearing aid system described above, in the detailed description and in the claims are—where appropriate—intended for being combined with the present method of manufacturing a hearing aid system.

A Software Program:

A software program stored on a computer readable medium is moreover provided by the present invention. When executed on a signal processing unit of a hearing aid system as described above, the software program implements one or more (such as a majority or all) of the steps of the method of adapting a hearing aid system as described above.

Further objects of the invention are achieved by the embodiments defined in the dependent claims and in the detailed description of the invention.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present. Furthermore, "connected" or "coupled" as used herein may include wirelessly connected or coupled. As used herein, the term "and/or" includes any and all combinations of one or more of the associated listed items.

BRIEF DESCRIPTION OF DRAWINGS

The invention will be explained more fully below in connection with a preferred embodiment and with reference to the drawings in which.

The figures are schematic and simplified for clarity, and they just show details which are essential to the understanding of the invention, while other details are left out. Throughout, the same reference numerals are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

FIG. 1 shows the basic components of a hearing aid system 100.

Figure 1A:
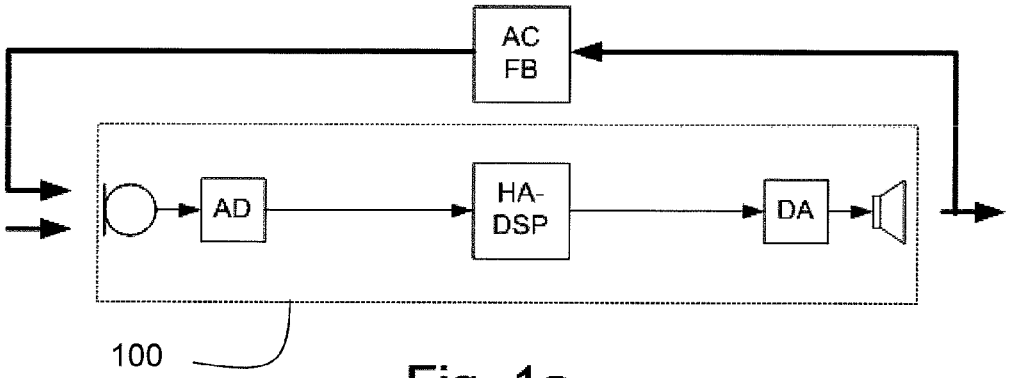
FIG. 1 shows the forward path of an exemplary hearing aid (FIG. 1*a*), the forward path and an electrical feedback cancellation path of an exemplary hearing aid (FIG. 1*b*), and a part of a hearing aid comprising an Online Feedback Manager (OFBM) according to an embodiment of the invention (FIG. 1*c*).

FIG. 1*a* illustrates the forward path and an (unintentional) acoustical feedback path of a hearing aid. In the present embodiment, the forward path comprises an input transducer for receiving an acoustic input from the environment, an AD-converter, a processing part HA-DSP for adapting the signal to the needs of a wearer of the hearing aid, a DA-converter (optional) and an output transducer for generating an acoustic output to the wearer of the hearing aid. The intentional forward or signal path and components of the hearing aid are enclosed by the dashed outline denoted 100. An (external, unintentional) acoustical feedback path ACFB from the output transducer to the input transducer is indicated.

Figure 1B:
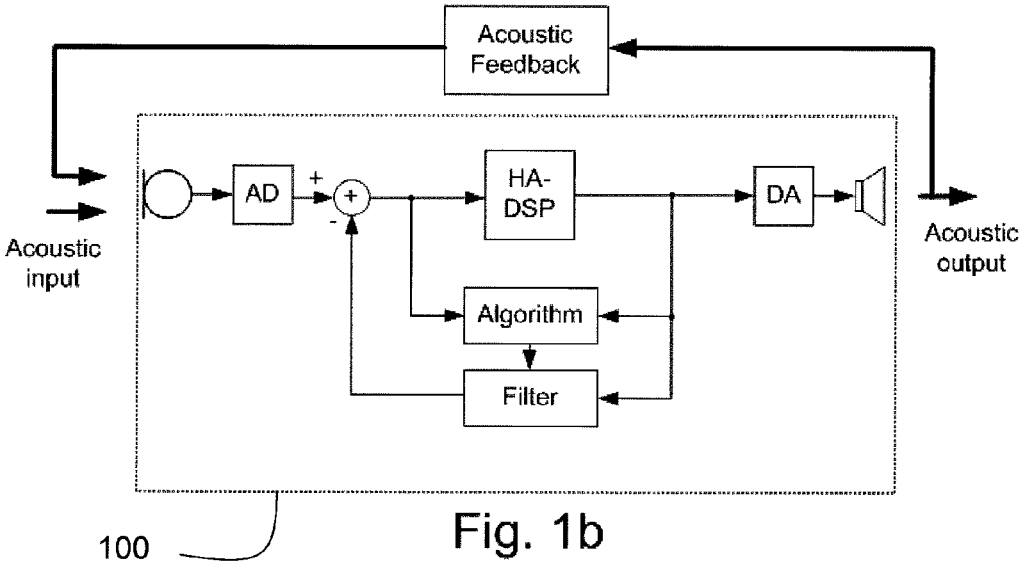

FIG. 1*b* illustrates a hearing aid 100 as in FIG. 1*a*, additionally comprising an electrical feedback cancellation path for reducing or cancelling acoustic feedback from an 'external' feedback path from output to input transducer of the hearing aid (termed 'Acoustic Feedback' in FIG. 1*b*). Here the electrical feedback cancellation path comprises an adaptive filter, which is controlled by a prediction error algorithm, e.g. an LMS (Least Means Squared) algorithm, in order to predict and cancel the part of the microphone signal that is caused by feedback from the receiver of the hearing aid. The adaptive filter (in FIG. 1*b* comprising a 'Filter' part and a prediction error 'Algorithm' part) is aimed at providing a good estimate of the 'external feedback path' from the input of the DA to the output from the AD. The prediction error algorithm uses a reference signal together with the (feedback corrected) microphone signal to find the setting of the adaptive filter that minimizes the prediction error when the reference signal is applied to the adaptive filter. The forward path (alternatively termed 'signal path') of the hearing aid comprises signal processing (termed 'HA-DSP' in FIG. 1*b*) to adjust the signal to the (possibly impaired) hearing of the user.

The functional parts of the present invention preferably form part of the loop constituted by the forward path and the electrical feedback path and can e.g. be an integral part of the processing unit (HA-DSP in FIG. 1*b*) or the adaptive filter (possibly all located on the same integrated circuit). Alternatively, they may be implemented partially or fully separate there from.

Figure 1C:
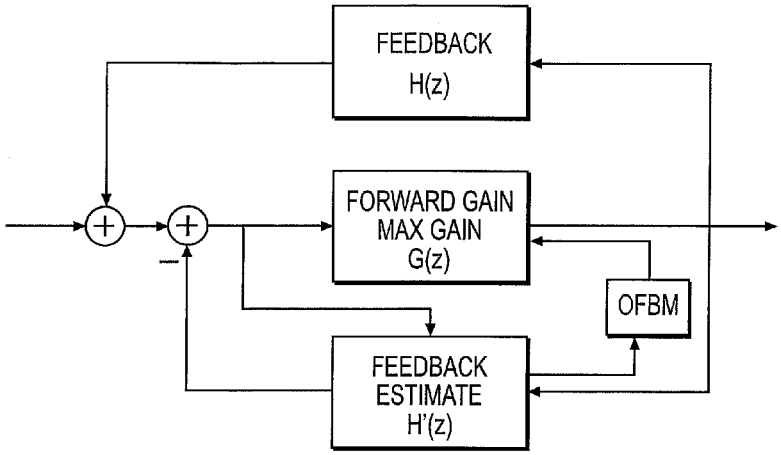

FIG. 1*c* shows a part a hearing aid comprising an Online Feedback Manager ('OFBM' in FIG. 1*c*) according to an embodiment of the invention. FIG. 1*c* illustrates a forward path comprising a forward gain block G(z) defining a maximum gain, an acoustical feedback path comprising a feedback contribution H(z), and a (electrical) feedback path comprising an adaptive filter for calculating an estimate H'(z) of the acoustical feedback, the latter e.g. forming part of a conventional DFC system. The OFBM uses the feedback path estimate from the DFC system to calculate the maximum forward gain. The (current) forward gain is calculated by the compression system (signal processor, forward gain block G(z)).

Figure 7:
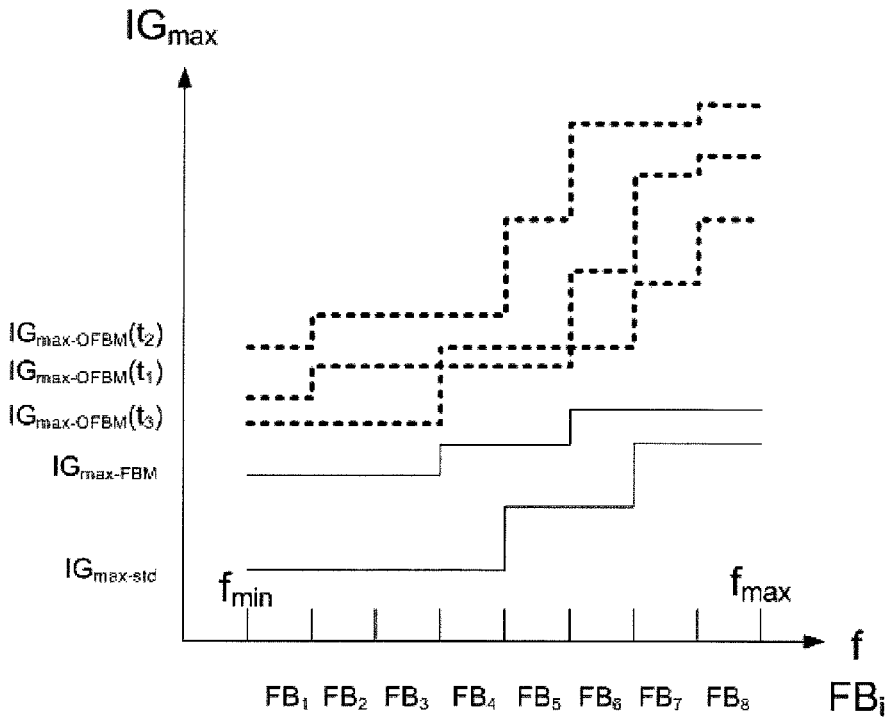
FIG. 7 is a sketch of different settings of the maximum forward gain $IG_{max}$ vs. frequency for an embodiment of a hearing aid system according to the invention.

FIG. 7 is a sketch of different settings of the maximum forward insertion gain $IG_{max}$ vs. frequency f (or frequency band $FB_i$, here i=1, 2, . . . , 8) of the processor of a hearing aid system for the frequency range $[f_{min}; f_{max}]$ between a minimum frequency $f_{min}$ and a maximum frequency $f_{max}$. In practice $f_{min}$ can be between 5 and 50 Hz, e.g. 20 Hz and $f_{max}$ between 8 kHz and 25 kHz, e.g. 12 kHz and the number of frequency bands alternatively be any appropriate number, e.g. 4 or 16 or 24 or 32 or 64 or 128 or larger.

The graph $IG_{max\text{-}std}$ indicates a standard setting of the maximum allowable forward gain for the different frequency bands, such as e.g. the (relatively conservative) setting of a hearing aid system directly from the manufacturer. $IG_{max\text{-}FBM}$ indicates a setting (predefined values (pd)) of maximum allowable forward gain, such as e.g. adapted by an audiologist using an offline 'feedback manager' (or using an automated procedure, e.g. a software tool running on a PC) to adjust the settings to a hearing profile of a given user. The graphs $IG_{max\text{-}OFBM}(t_n)$ schematically indicate stored values of the maximum allowable forward gain for each frequency band at time $t_n$ as suggested by the present invention, here indicated by times $t_1$, $t_2$, $t_3$.

The feedback limits in a hearing aid can be defined by the $IG_{max}$ (maximum insertion gain) parameters. A total of N $IG_{max}$ parameters are available—one for each frequency band, where N is the number of frequency bands. For each parameter both the target value and a fade-rate can be defined (the target value being the $IG_{max,i}(t_n)$ value determined by the OFBM at a given point in time $t_n$, and the fade-rate being the rate $FR_i$ (for the $i^{th}$ frequency band) at which currently applied $IG_{max,i}(t_n)$ (appropriately faded) values converge (lades') towards the target value $IG_{max,i}(t_n)$. The feedback limits $FBG_{max}$ (and thereby the $IG_{max}$ parameters) are typically defined during the fitting process—as pre-scribed (predefined) values based on characteristics of the actual hearing instrument, including the size of a possible vent, etc. The maximum feedback values applied are often a rather conservative estimate, and are typically several dB above the actual feedback limit, in order to account for variations in the user environment. The use of an OFBM according to the present invention enables the use of less conservative estimates and thereby extending the fitting range of the hearing aid.

Figure 8:
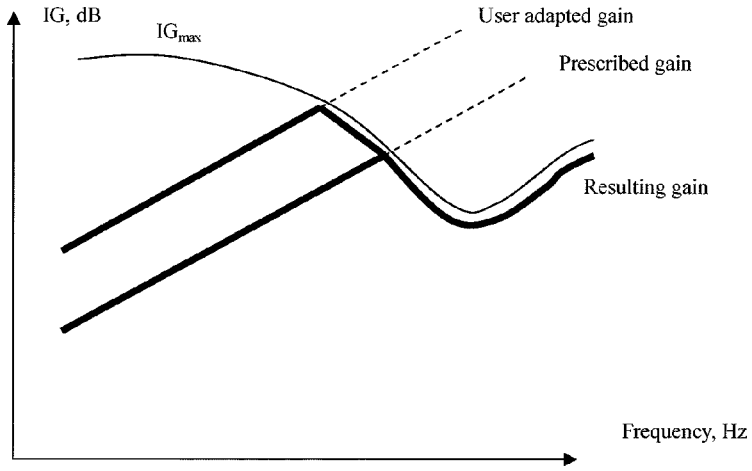
FIG. 8 shows the influence of maximum insertion gain $IG_{max}$ on current insertion gain IG (here shown in a continuous picture; in practice the frequency range is divided into a number of bands as illustrated in FIG. 7), where IG is automatically adjusted according to $IG_{max}$. The resulting IG is represented by thick lines.

The idea behind the OFBM is to control the $IG_{max}$, which is used to limit insertion gain (IG) available for the wearer of the hearing aid according to the current user situation. Typically feedback (FB) occurs at high frequencies, so when e.g. the wearer or a dispenser increases the IG (by means of e.g. the volume control), then it will automatically be limited according to the $IG_{max}$ parameters. This fact is illustrated in FIG. 8 showing the resulting IG, partly as prescribed IG, and partly as individual IG, if the wearer wishes more gain than prescribed. The OFBM will continuously update the $IG_{max}$ according to the user situation.

Figure 9:
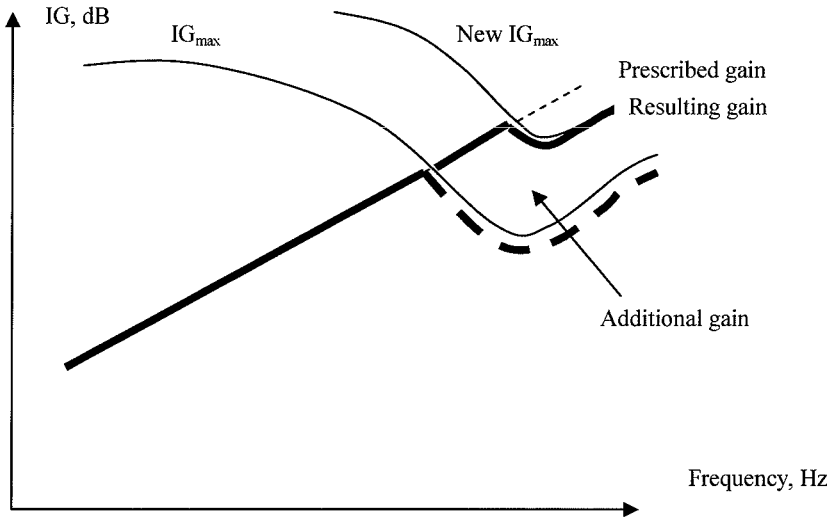
FIG. 9 illustrates a situation where more gain is supplied to the user, when the OFBM is updated resulting in an increase in $IG_{max}$.

The OFBM may change $IG_{max}$ in direction of more gain, see FIG. 9. The consequence may be that gain for the user will be higher. It should be noted, though, that this is not necessarily of benefit in all situations since more gain make sounds become more dominating and perhaps with poor sound quality since headroom (compression and Maximum Power Output (MPO)) is not increased in same manner. Therefore, the audiologist needs to define an upper limit for the $IG_{max}$ of the OFBM (not shown in FIG. 9).

Figure 10:
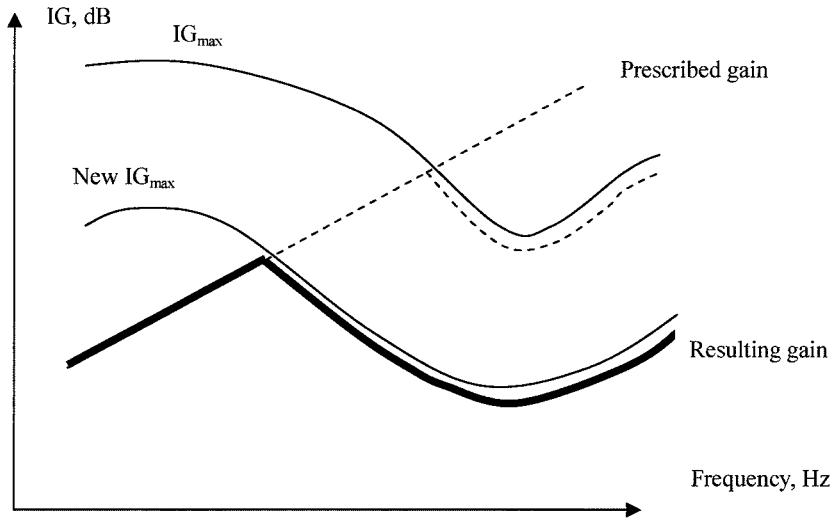
FIG. 10 illustrates a situation when the OFBM is updated resulting in a decrease in $IG_{max}$.

On the other hand the OFBM may decrease $FBG_{max}$ or $IG_{max}$, for example when the ear mould is not mounted correctly in the ear, see FIG. 10. The gain available for the user may be so low that some sounds become inaudible. To prevent this situation, a minimum limit for $FBG_{max}$ or $IG_{max}$ of the OFBM can be implemented (not shown in FIG. 10). In certain situations the OFBM may not be able to suppress the howling due to this minimum limit, but the occurrence of howl will remind the user or the care keeper to reinsert the ear mould in a correct manner.

Figure 11:
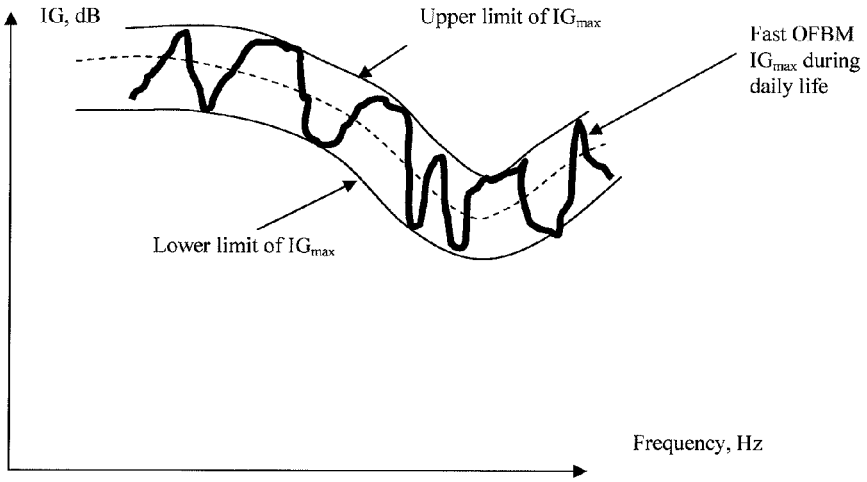
FIG. 11 shows an example of daily varying $IG_{max}$ as found by an embodiment of the fast OFBM according to the invention. Examples of maximum (upper solid curve) and minimum limits (lower solid curve) of $IG_{max}$ (as e.g. allowed by an audiologist) are indicated. The dotted curve may represent $IG_{max}$ as determined by an automated procedure during fitting (e.g. by a software programming tool).

Based on the requirements of upper and lower limits for $FBG_{max}$ (e.g. as determined by an audiologist's or an automated procedure), the allowable area for the $FBG_{max}$ variation of a fast OFBM according to an embodiment of the present invention is schematically illustrated in FIG. 11.

Figure 12:
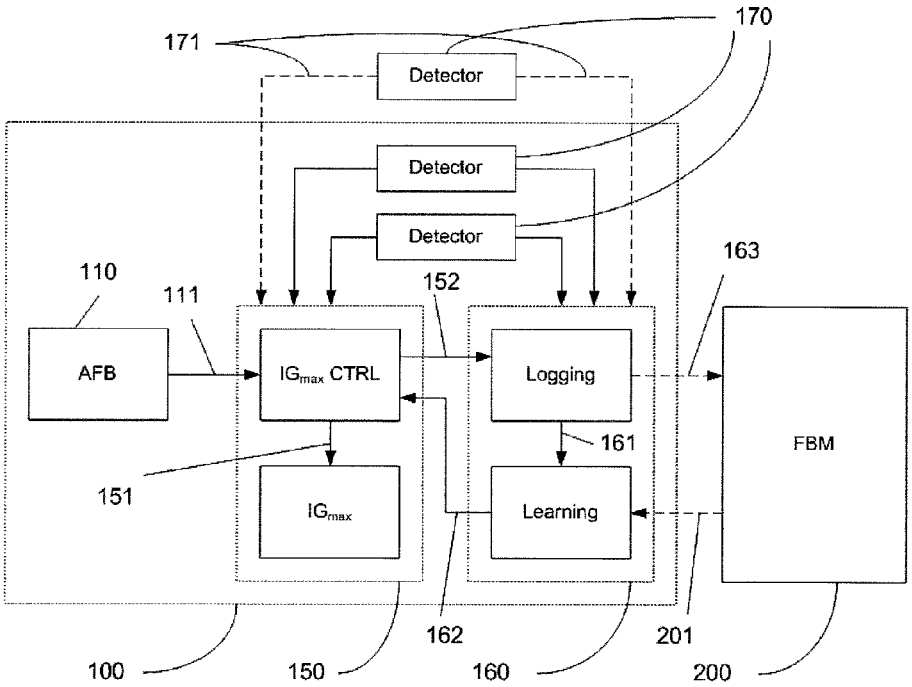
FIG. 12 shows a block diagram of a part of an embodiment of a hearing aid comprising an OFBM according to the present invention.

FIG. 12 schematically shows a block diagram of parts of an embodiment of a hearing aid system 100 comprising an anti feedback system (AFB) 110 and an OFBM (comprising a Fast OFBM 150 and a Slow OFBM 160) according to the present invention. The Fast OFBM 150 uses input 111 from the AFB-system 110 (e.g. loop gain calculation, feedback and leak detection) to calculate ('$IG_{max}$ CTRL' in FIG. 12) new target values and fade rates 151 for the N (e.g. 16) $IG_{max}$ parameters in the gain block ('IGmax' in FIG. 12) of the signal processor. The Slow OFBM 160 continuously logs ('Logging' in FIG. 12) the correction of $IG_{max}$ from the fitted values and calculates a time average for each of the N (e.g. 16) frequency bands. These average values 161 are then used to update the target values for $IG_{max}$, here shown as signals 162 from a 'Learning' module to the $IG_{max}$ CTR-block. Optional detectors 170 (e.g. directionality detector, mode detector, volume control, acoustic environment detector, location detector, etc.), which may form part of the hearing aid system 100 or be external to the hearing aid system are shown providing inputs 171 to the Fast and/or Slow OFBM units. In FIG. 12 a Fast and Slow OFB are shown to work in cooperation. Alternatively each of them may be used alone. The hearing aid system 100 is shown to be connectable to an external 'offline' FeedBack Manager 200 ('FBM' in FIG. 12), e.g. indicating a software tool (e.g. run on a PC) of an audiologist for making a fitting of the hearing aid system to a wearer's needs. Data 163 from the logging system of the Slow OFBM 160, including logged $IG_{max}$ values for each frequency band and for a number of different points in time may be forwarded to the FBM for further analysis. Optional connection 201 is indicated for forwarding data from the FBM to the OFBM, e.g. preset values $IG_{max\text{-}FBM}$ to $IG_{max}$ CTRL-block of the (fast) OFBM via the Learning-block of the (slow) OFBM. The communication between the hearing aid system 100 and optional external detectors 170 or programming units 200 or other devices may be wired or wireless and based on electrical or optical signals.

If the average correction exceeds a certain threshold, indications could be given to the wearer in the form of beeps or blinks.

As indicated in FIG. 12, the OFBM can be adapted to accept inputs from other detectors in the system in order to obtain the desired functionality.

Each of the three OFBM blocks will be treated separately in the following sections.

Fast OFBM with AFB

The Fast OFBM is a system that updates $IG_{max}$, e.g. once every second. If the update speed becomes much slower (e.g. more than 5-10 s between updates) interaction from other automatic features in the HA (directional microphone system, learning modes, etc.) will influence the OFBM performance.

Core OFBM System:

The Fast OFBM works more or less in the same way as a feedback manager of a software programming tool, such as e.g. used by an audiologist when adapting a hearing instrument to a particular wearers needs. It attacks the problem that causes AFB problems directly; namely the loop gain. Loop gain is the sum of the gain in the feedback path and the gain in the signal path and when this value gets too large, the HA starts to sound "bad", and when the value surpasses 0 dB, the HA is likely to howl. The goal of the OFB is to keep the AFB within the interval of loop gains that can be handled by the AFB system.

The resulting, frequency (f) dependent, loop gain LG is essentially calculated as follows:

$$LG(f)=H_{DFC}(f)+H_{SP}(f)$$

where $H_{DFC}$ is the feedback estimate of the AFB-system, $H_{SP}$ is the signal processor gain. The practical implementation of the $H_{DFC}$ and $H_{SP}$ transfer functions can comprise FIR- or IIR-filters or any other appropriate components.

A method which will restrict loop gain to a specified maximum value can be implemented. Such a method both prevents feedback howls from occurring and eliminates feedback howls after they occur and comprises: a) In a static situation, determine (in each frequency interval) the critical (maximum) loop gain to avoid howling $LG_{howl}$, which can be handled by the AFB system. b) Decide an appropriate gain margin in each frequency band and subtract this value from corresponding $LG_{howl}$ values, resulting in values for the maximum allowed loop gain $LG_{max}$ for each frequency band. To enforce this loop gain we would then perform the following steps for each of the frequency intervals (e.g. 16).

1. The maximum gain in the AFB FIR filter for the frequency interval is determined. We will call this value $AFB_{max}$.
2. From this value we can directly calculate the maximum value of $IG_{max}$ to keep the AFB system operating within the desired loop gain interval. $IG_{max}=LG_{max}-AFB_{max}$. Preferably, threshold values restricting the interval wherein $IG_{max}$ can be adjusted, are defined ([$IG_{max,high}$; $IG_{max,low}$]). This limits the influence of the $AFB_{max}$ values, which may be relatively inaccurate.

The value, which is calculated and applied to $IG_{max}$ is applied to the target $IG_{max}$; the actual $IG_{max}$ used by the hardware, current $IG_{max}$, fades towards this value. This will keep the OFBM stable. The fade rates should preferably be adjusted so that the OFBM can reduce gain relatively quickly and increase gain over a longer time interval.

Parameters for the Fast OFBM System

To configure the Fast OFBM system the following parameters will be introduced

| Name | Values | Description |
|---|---|---|
| ofbmon | 1:0 | Global OFBM enabled/disabled |
| Ofbmactive.[1:16] | 1:0 | OFBM enabled/disabled in each frequency band. Ignored if ofbmon = 0. |
| max_igmax_thresholds.[1:16] | 0:96 dB | Maximum allowed value for target $IG_{max}$ in each frequency band where OFBM is enabled. |
| min_igmax_thresholds.[1:16] | 0:96 dB | Minimum allowed value for target $IG_{max}$ in each frequency band where OFBM is enabled. |
| max_loopgain.[1:16] | −48:48 dB | The maximum allowed loop gain in each frequency interval. |
| delta_howl_atten.[1:16] | 0:96 dB | How much to reduce $IG_{max}$ by instantaneously in frequency band with positive tone detection. |
| leak_hold_ofbm_time | 0:255 | How many seconds the OFBM should be paused after a leak has occurred. |

In addition, it will be possible to adjust the fade rates up/down in $IG_{max}$.

Slow OFBM (in Addition to a Fast OFBM)

The Slow OFBM continuously logs data from the Fast OFBM and uses this as input to a learning routine. As the name suggests the adaptation of the Slow OFBM is much slower than the Fast OFBM. However, the adjustments made to $IG_{max}$ may be greater than what the Fast OFBM does.

Figure 13:
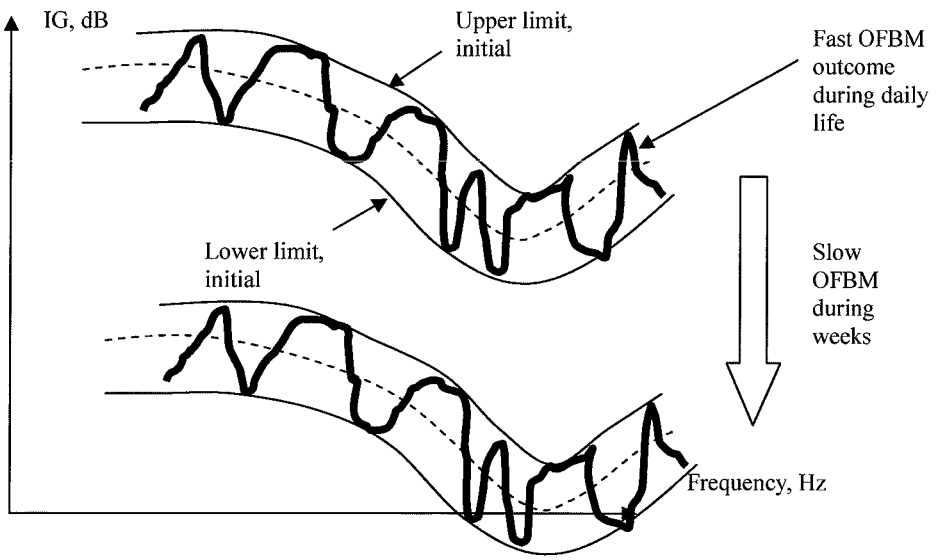
FIG. 13 illustrates the combined effects of a fast and slow OFBM according to an embodiment of the present invention. Upper curves represent $IG_{max}$ when initially or preliminary fitted or estimated (dotted curve) and accepted maximum (max, high) and minimum (max, low) limits e.g. as determined by an audiologist (solid curves) are used. Lower curves represent $IG_{max}$ after some time (weeks and months) also with maximum and minimum limits.

In cases where an ear mould becomes loose in the ear (the ears of a child grow or the ear mould becomes smaller during time, etc.), it may be acceptable to reduce both the upper and lower limit of $FBG_{max}$ (or $IG_{max}$), cf. FIG. 11. This is illustrated in FIG. 13. However, a requirement of this reduction is that it is slow in time (i.e. corresponds to the growth of a child ear, for example maximum reduction of 2 dB a week), in other words that the update frequency is relatively low, e.g. <0.01 Hz.

FIG. 13 illustrates the combined effects of a fast and slow OFBM according to an embodiment of the present invention. Upper curves represent $IG_{max}$ when initially or preliminary fitted or estimated (dotted curve) and accepted maximum and minimum limits e.g. as determined by an audiologist (solid curves). Lower curves represent $IG_{max}$ after some time (weeks and months) also with maximum and minimum limits. The difference between upper and lower curves is due to an adaptation process of the slow OFBM, and the gain change velocity (dB/week) of the adaptation is e.g. specified by the audiologist (e.g. maximum gain reduction of 1 dB/week, such as 2 dB a week, such as 3 dB/week) during an initial or later fitting of the system using an off-line feedback manager tool.

Parameters for the Slow OFBM System

The slow OFBM system is based upon input from a statistical surveillance of the fast OFBM system. It can advantageously be applied in connection with ear moulds for children, which gradually become too small. Contrary to a wrongly inserted ear mould, this condition will be handled by the fast OFBM as long as it can reduce gain within the allowed attenuation limit min_igmax_thresholds (cf. table above). However, as the mould gets looser, a further reduction may be needed as well as a decreased default_igmax_threshold (cf. e.g. dotted line in FIG. 13). The default values and lower limit values would then be updated with new settings (both saved in a memory, e.g. an EEPROM, of the system). The upper limits/gain margin is preferably also updated towards less allowed $IG_{max}$.

Thus, if the adjustments made by the fast OFBM are often truncated by the limits, this will be identified by the slow OFBM, and action is taken:

The default settings will be updated in accordance with predefined rules (cf. examples below). In this way the fast OFBM does not have to compensate for this in the future.

It may be relevant to allow the system also to increase limits, in cases where too conservative values have been applied to be sure to avoid howl.

Information may be passed on to a warning system that is responsible for notifying the user or another relevant person about the problem.

Depending on the application (product) it may be relevant to let the Slow OFBM interact with the Fast OFBM in different ways. Therefore the system is preferably configurable so that it can selectably:

use same or different learning steps in the different frequency bands, i.e. change the entire $IG_{max}$ response curve individually or adjust all bands equally.

let the system be open to band specific learning (in OFBM enabled bands). This can be used to influence soft gain response and sound quality.

use band specific learning with dynamic range constraints.

Time Constants of the Slow OFBM?

In an embodiment, the slow OFBM only updates EEPROM settings (e.g. default_igmax_threshold), i.e. the effect of the slow OFBM is only applied to the gain path after a boot of the processor or a program change. User information may be given at any time, i.e. not only at start-up.

The slow OFBM may be considered equivalent to an audiologist renewing the fitting once at a week. It has the advantage of avoiding a time consuming refitting by an audiologist, which is in general would not be practical at such a high frequency.

A wearer, at least one with severe/profound hearing loss, is assumed to use the hearing aid every day, and therefore reboots the hearing aid system every morning or when being aided with the hearing aid. Accordingly, the wearer will not notice immediately the gain change (e.g. with max 2 dB change a week since this would correspond to ⅓ dB change a day). Information from a wearer may be fed into the system.

One or more of the following parameters are preferably added for improved function of the slow OFBM:

- Maximum rates of adaptation in upwards and downwards direction (e.g. 2 dB a week).
- Step sizes of adaptation.
  - Use of different values in the different bands.
- Dispensers'/audiologist's accept of increasing $IG_{max}$ above $FBG_{max}$ as determined by an automatic procedure or a predefined setting (a yes/no parameter). Here an upper limit of $IG_{max}$ can be included (=max_ig-max_thresholds, see table above) for preventing extreme increases.
- User information to warn about the system consequently turning down (or up) limits.

Rules

The default settings of gain characteristics of the hearing aid are preferably updated in upwards or downward direction in accordance with predefined rules in dependence on selected learning principles.

Same Learning in all Bands:

In an embodiment, a histogram of the number of bands truncated by a limit at each update for the fast OFBM is produced. This histogram represents the likelihood of a given number of bands in need for a larger $IG_{max}$ change than allowed. If the histogram median is high (larger than a predefined value), a learning update is needed. Learning updates and histogram scaling (forgetting) are preferably done at regular (predefined) intervals in time. Separate histograms for upwards and downwards learning are preferably produced.

Band Specific Learning:

Here, the average $IG_{max}$ changes relative to the default value for each band are logged. If the average exceeds a predefined threshold value, a learning step is performed, if it is within (predefined) dynamic range constraints of other (e.g. adjacent) bands. Learning-updates and average scaling (forgetting) are preferably done at regular (predefined) intervals in time.

EXAMPLE 1

OFBM1, Use of an (Relatively Fast) OFBM as an AFB-system

Standalone:

The OFBM1 is able to work as an (standalone) AFB system, if the target (predefined gain limit) for the OFBM1 is <0 dB loop gain and the system has a relatively fast update speed of e.g. 100 ms (i.e. an update frequency around 10 Hz). The closer the target loop gain is to 0 dB the faster a system is needed (the higher the update frequency). If the target is below 0 dB loop gain, the DFC system can be bypassed and only used for estimating the feedback path (cf. FIG. 2).

Figure 2:
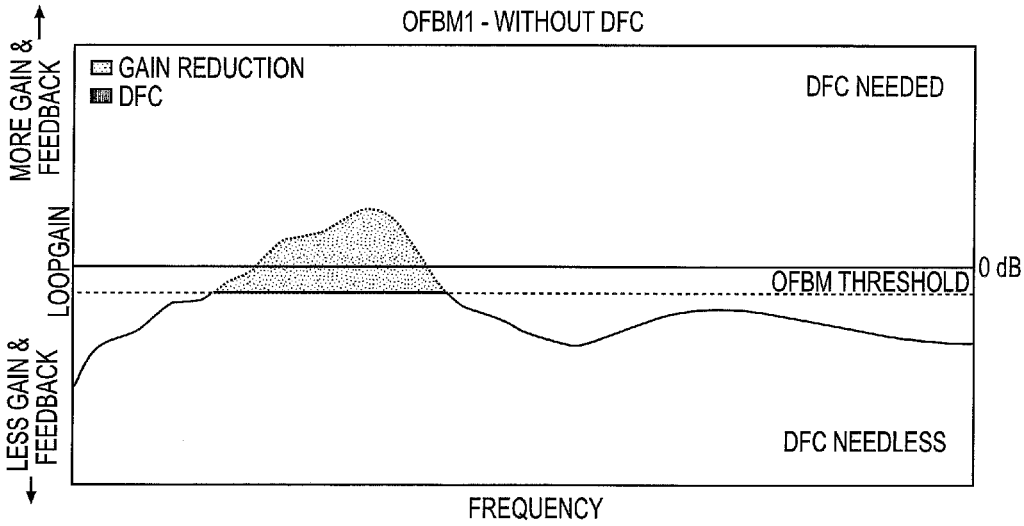
FIG. 2 shows a loop gain vs. normalized frequency curve for a hearing aid system according to an embodiment of the invention comprising an online feedback manager unit OFBM1 used as an AFB system without a dedicated DFC system.

FIG. 2 shows a loop gain vs. normalized frequency curve for a hearing aid according to an embodiment of the invention comprising an online feedback manager unit OFBM1 used as an AFB system without a dedicated DFC system. The normalized frequency range corresponds to a real frequency range of e.g. 20 Hz to 12 kHz. The OFBM1 system uses the feedback estimate to control the maximum gain of the feedback loop. The DFC is not needed, because the feedback is removed by gain reduction. A slower system (lower update frequency) needs a lower threshold (lower predefined gain limit).

Figure 3:
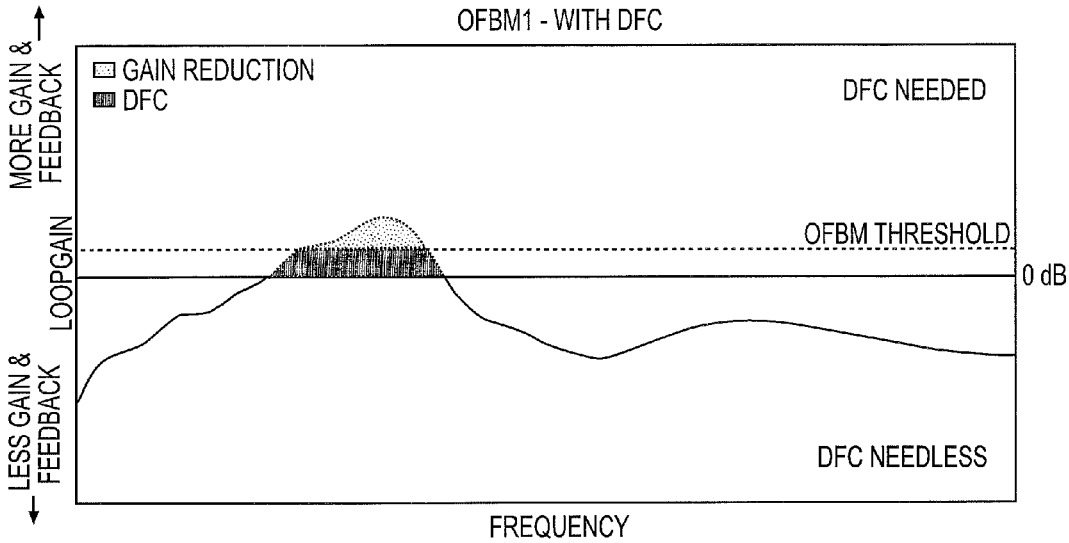
FIG. 3 shows a loop gain vs. normalized frequency curve for a hearing aid system according to an embodiment of the invention comprising an online feedback manager unit OFBM1 used as an AFB system combined with a DFC system.

Combined with Existing DFC-system:

FIG. 3 shows a loop gain vs. normalized frequency curve for a hearing aid according to an embodiment of the invention comprising an online feedback manager unit OFBM1 used as an AFB system combined with a DFC system. If the target (predefined gain limit) is above 0 dB loop gain, the DFC system is still needed, but the working interval of the OFBM will be constrained to a predefined loop gain limit, e.g. maximum 3 dB loop gain, because the OFBM1 will continuously (i.e. with a certain update frequency) reduce the forward gain to achieve maximum 3 dB loop gain (cf. FIG. 3). Above the threshold, feedback is removed by gain reduction. Between 0 dB loop gain and the threshold, feedback is removed using the DFC.

In this setup the OFBM will work as a stand-alone AFB system (if the target is <0 dB and the DFC system is used for feedback estimation only) or as a parallel system to the DFC system (if the target is >0 dB loop gain). In both setups the OFBM1 will have a major impact on the forward gain and will depend on a reliable feedback path estimate from the DFC system.

Using the OFBM as a parallel AFB system opens up for interactions between the DFC system and the OFBM. The OFBM1 will reduce the gain where the loop gain is above the limit, and reducing the gain will make it more difficult for the DFC system to estimate the feedback path in that region. When using the feedback path estimate from the DFC system, the OFBM will always be slower than the DFC system and will decrease the gain after the DFC system has estimated the feedback path and removed the feedback signal.

Implementation:

The coefficients from the DFC system are used to calculate the frequency response in a processor and from the frequency response the maximum feedback in each band are found. This maximum feedback determines the maximum gain in the forward path.

In an embodiment, the OFBM is constrained to a predefined maximum allowed change per update, e.g. only allow +/−2 dBs of change.

EXAMPLE 2

OFBM2, Use of an (Relatively Fast) OFBM as a Feedback Limiter

Figure 4:
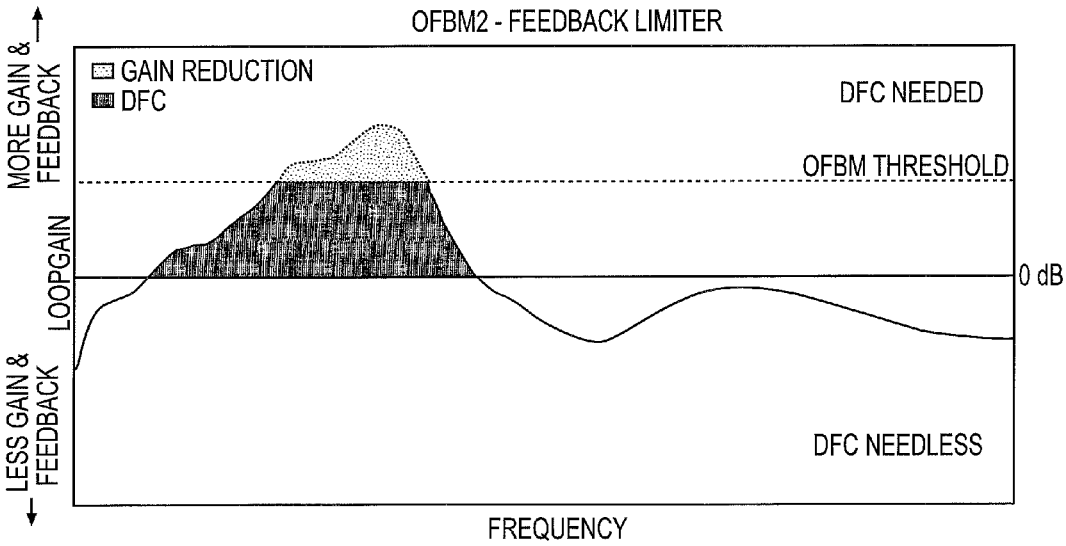
FIG. 4 shows a loop gain vs. normalized frequency curve for a hearing aid system according to an embodiment of the invention comprising an online feedback manager unit OFBM2 used as feedback limiter.

The OFBM can be used to limit the maximum loop gain. The working interval for the DFC system is from −∞ dB to +∞ dB loop gain. This interval is difficult to handle, and it is well known that a working interval from about 0 dB to 12 dB loop gain is the optimum for the DFC system. Using the OFBM to limit the maximum loop gain ensures that the DFC system will not be pushed too much: If the loop gain increases above the limit (predefined gain limit), the forward gain will be reduced and thus increase the ability for the DFC system to remove the feedback. This can be seen as changing the working interval for the DFC from −∞ dB to +∞ dB loop gain to e.g. −∞ dB to a predefined gain limit, here +12 dB loop gain (cf. FIG. 4). FIG. 4 shows a loop gain vs. normalized frequency curve for a hearing aid according to an embodiment of the invention comprising an online feedback manager unit OFBM2 used as feedback limiter. If the loop gain exceeds the threshold (predefined gain limit), the gain is reduced.

In this setup, the OFBM will only be active in situations where the user will experience artefacts and bad sound quality, because of too high loop gain and a DFC system that is pushed too hard. The gain will be reduced but only in situations where the user has no need of it.

The OFBM2 is not dependent on a reliable estimate each 100 ms, but can wait to certain requirements are fulfilled, such as a minimum variation in the feedback estimate, detectors, or similar indicators of the reliability of the estimated feedback.

External tones in a given frequency band will increase the feedback path estimate thus decreasing the max gain in that frequency band. This might be a problem: When the tone stops, we want as much gain in that region as possible to get a reliable estimate. A similar situation can occur, when a telephone receiver is placed at the ear: The feedback path increases with e.g. 14 dB between 3 and 4 kHz. This increase will make the OFBM2 reduce the forward gain in that frequency region. When the telephone receiver is removed it might be difficult to detect because not much gain is found in the affected area. This problem can be diminished by defining a more flat max gain vs. frequency curve (i.e. not 'too peaky').

EXAMPLE 3

OFBM3, Use of an (Relatively Slow) OFBM as a Feedback Optimizer

The OFBM3 can be seen as an adaptive addition to the initial max gain $IG_{max}$ set during an initial (or later) fitting procedure (e.g. by an audiologist). It is known that the feedback path will change over time as a result of the different conditions through the day or days. The target of the OFBM3 is to slowly update the max gain to follow these changes.

Figure 5:
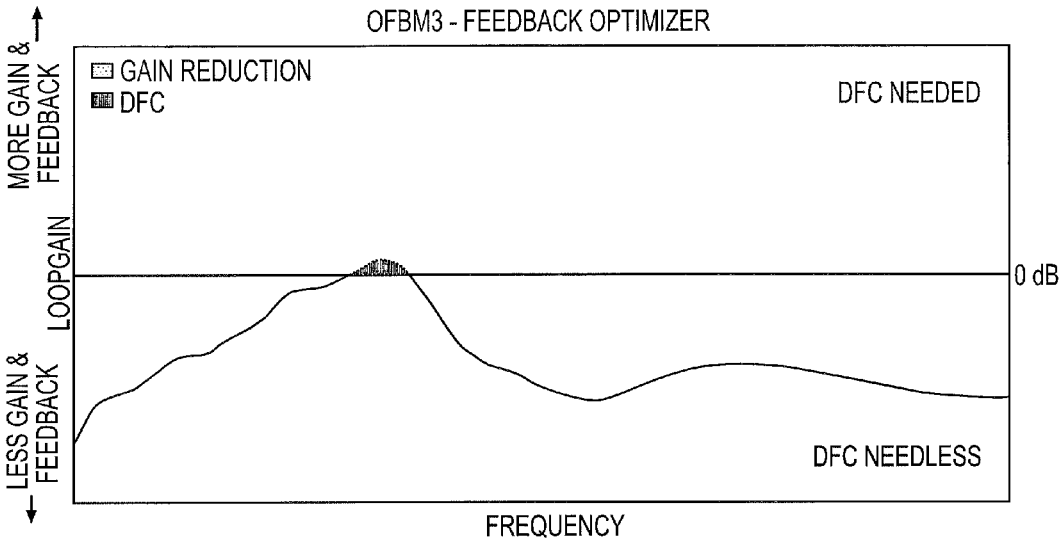
FIG. 5 shows a loop gain vs. normalized frequency curve for a hearing aid system according to an embodiment of the invention comprising an online feedback manager unit OFBM3 used as feedback optimizer in a case of too low maximum gain.

If the max gain is too low, the user has less gain than wanted and the DFC system has problems estimating the feedback path (cf. FIG. 5). FIG. 5 shows a loop gain vs. normalized frequency curve for a hearing aid according to an embodiment of the invention comprising an online feedback manager unit OFBM3 used as feedback optimizer in a case of too low maximum gain. The maximum gain is too restrictive, so the user might not get the wanted gain.

Figure 6:
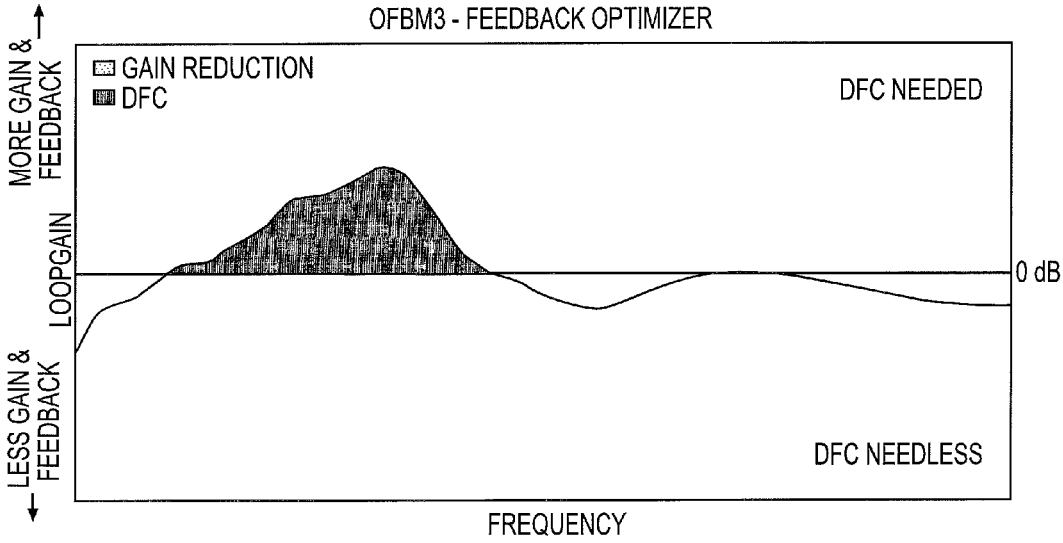
FIG. 6 shows a loop gain vs. normalized frequency curve for a hearing aid system according to an embodiment of the invention comprising an online feedback manager unit OFBM3 used as a feedback optimizer in a case of too high maximum gain.

If max gain $IG_{max}$ is too high, it will be more difficult for the DFC system to handle quick and large increases in the feedback path (cf. FIG. 6). FIG. 6 shows a loop gain vs. normalized frequency curve for a hearing aid according to an embodiment of the invention comprising an online feedback manager unit OFBM3 used as a feedback optimizer in a case of too high maximum gain. If a sudden increase in the feedback path occurs, the loop gain can get too high for the DFC system.

The OFBM3 is based on the assumption that it is possible to get a reliable feedback estimate on average over time, e.g. several minutes (the update frequency is e.g. smaller than or equal to 0.01 Hz). If this assumption is met, the OFBM3 could relax the safety margin used when presetting the max gain of the hearing aid.

Compared to the other OFBM systems (OFBM1, OFBM2), OFBM3 updates $IG_{max,i}$ continuously (i.e. with the predefined update frequency) independent of the loop gain $LG_i$. The other OFBM systems (OFBM1, OFBM2) only update current insertion gain IG ($t_n$) when the loop gain exceeds a chosen threshold (predefined loop gain limit $LG_{max,i}$).

The averaged estimated feedback path is affected by tonal input, small gain, or quick changes in the feedback path. The OFBM3 must take these problems into consideration. As opposed to the previously described OFBM systems, the OFBM3 will interact with changes in ADIR (ADIR=Adaptive DIRectionality=a functional block that shifts between an omni-directional mode (having a substantially equal sensitivity to sounds at all spatial angles) and a directional mode (having a better sensitivity at one or more preferred spatial angles (e.g. best sensitivity for sounds coming from one particular angle, e.g. from in front). Shifts in the ADIR have time constants of the order of seconds, e.g. 3-4 s, so the OFBM is preferably able to accommodate such time constants (be fast enough), e.g. 0.5 Hz$\geq f_{upd} \geq$0.1 Hz.

Different max gains can be used in different ADIR modes so the OFBM3 should preferably be able to handle these changes.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

REFERENCES

U.S. Pat. No. 5,619,580 (GN Danavox) Apr. 28, 1994
U.S. Pat. No. 6,219,427 (GN ReSound) Apr. 17, 2001
WO 2006/063624 (WIDEX) Jun. 22, 2006

The invention claimed is:

1. A hearing aid system, comprising:
an ear-mould for a child;
an input transducer;
a forward path;
an output transducer; and
an electrical feedback path, wherein
the forward path includes a signal processing unit configured to modify an electrical input signal to a specific hearing profile over a predefined frequency range,
the predefined frequency range includes a number of frequency bands, for which maximum forward gain values $IG_{max}$ for each band are stored in a memory, the maximum forward gain values $IG_{max}$ restricting loop gain to a predetermined value in each band,
the electrical feedback path includes an adaptive filter configured to estimate acoustical feedback from the output to the input transducer in each band,
the hearing aid system further includes
a relatively slow online feedback manager unit configured to, with a predefined update frequency, identify current feedback gain in each frequency band of the feedback path, and to subsequently adapt the maximum forward gain values $IG_{max}$ in each of the frequency bands in accordance with a predefined scheme, and
the relatively slow online feedback manager unit is configured to reduce the risk of howling by decreasing the maximum forward gain values $IG_{max}$ in said ear-mould for a child.

2. The hearing aid system according to claim 1, wherein
the predefined update frequency is smaller than or equal to 0.01 Hz, or
the relatively slow online feedback manager is configured to control the maximum rate of change of the maximum forward gain $IG_{max}$ to 3 dB per week or less.

3. The hearing aid system according to claim 1, wherein the relatively slow online feedback manager is configured to control the maximum rate of change of the maximum forward gain $IG_{max}$ to 3 dB per week or less.

4. The hearing aid system according to claim 3, wherein the relatively slow online feedback manager is configured to control the maximum rate of change of the maximum forward gain IGmax to 2 dB per week or less.

5. The hearing aid system according to claim 4, wherein the relatively slow online feedback manager is configured to control the maximum rate of change of the maximum forward gain $IG_{max}$ to 1 dB per week or less.

6. The hearing aid system according to claim 1, wherein the predefined update frequency is smaller than or equal to 0.5 Hz.

7. The hearing aid system according to claim 1, wherein the predefined scheme comprises that the maximum forward gain value for a frequency band is adapted solely on the basis of the current maximum feedback gain value for said frequency band.

8. The hearing aid system according to claim 1, wherein the predefined scheme requires that the maximum forward gain value for a frequency band is adapted so that the sum of the current maximum feedback gain and the maximum forward gain values is smaller than or equal to a predefined maximum loop gain value for that band.

9. The hearing aid system according to claim 7, wherein the maximum forward gain value is adapted so that the sum of the current maximum feedback gain and the maximum forward gain values is equal to a predefined maximum loop gain value for that band.

10. The hearing aid system according to claim 1, further comprising:

a relatively fast online feedback manager configured to operate at an update frequency greater than 1 Hz.

11. The hearing aid system according to claim 1, wherein the update frequency is adapted to the relevant hearing situation.

12. The hearing aid system according to claim 1, wherein the order of the predefined update frequency for the relatively slow online feedback manager is in the once every 100 hours range.

13. The hearing aid system according to claim 1, wherein the update frequency of the relatively fast online feedback manager is larger than or equal to 10 Hz.

14. A method of adapting a hearing aid system to varying acoustical input signals, the hearing aid system including an ear-mould for a child, an input transducer transforming an acoustical input signal to an electrical input signal, a forward path, an output transducer for transforming an electrical output signal to an acoustical output signal and an electrical feedback path, the forward path comprising a signal processing unit configured to modify an electrical input signal to a specific hearing profile over a predefined frequency range, wherein the predefined frequency range comprises a number of frequency bands that can be individually adapted, the electrical feedback path including an adaptive filter for estimating acoustical feedback from the output to the input transducer, the method comprising:

a) identifying maximum feedback gain in each frequency band;

b) calculating the loop gain in each of the frequency bands based on previously stored values of maximum forward gain and said maximum feedback gain;

c) checking whether the loop gain is above a certain maximum loop gain value in each frequency band;

d1) if the loop gain is above the certain maximum loop gain value, decreasing the maximum forward gain values $IG_{max}$ in that frequency band;

d2) if the loop gain is not above the certain maximum loop gain value, continuing without changing the maximum forward gain $IG_{max}$ in that frequency band;

e) storing in a memory the new values of the maximum forward gain $IG_{max}$ in each frequency band; and f) repeating the algorithm a)-e) with a predefined update frequency.

15. The method according to claim 14, wherein in step d1 the maximum forward gain $IG_{max}$ is decreased with a predefined amount.

16. The method according to claim 14, wherein in step d1 the maximum forward gain $IG_{max}$ is decreased at most to a predetermined fraction of said predetermined maximum loop gain value in each frequency band.

17. The method according to claim 14, wherein the predefined update frequency is smaller than or equal to 0.01 Hz, or the maximum rate of change of the maximum forward gain $IG_{max}$ is 3 dB per week or less.

18. The method according to claim 14, wherein the maximum rate of change of the maximum forward gain $IG_{max}$ is 2 dB per week or less.

19. The method according to claim 18, wherein the maximum rate of change of the maximum forward gain $IG_{max}$ is 1 dB per week or less.

20. The method according to claim 14, wherein the predefined update frequency is smaller than or equal to 0.5 Hz.

* * * * *